US008177302B2

(12) United States Patent
Carlson et al.

(10) Patent No.: US 8,177,302 B2
(45) Date of Patent: May 15, 2012

(54) SEAT CUSHION

(75) Inventors: J. Martin Carlson, Mora, MN (US); Mark J. Payette, Hugo, MN (US)

(73) Assignee: Tamarack Habilitation Technologies, Blaine, MN (US)

( * ) Notice: Subject to any disclaimer, the term of this patent is extended or adjusted under 35 U.S.C. 154(b) by 159 days.

(21) Appl. No.: 12/918,876

(22) PCT Filed: Mar. 5, 2009

(86) PCT No.: PCT/US2009/001404

§ 371 (c)(1),
(2), (4) Date: Aug. 23, 2010

(87) PCT Pub. No.: WO2009/111039

PCT Pub. Date: Sep. 11, 2009

(65) Prior Publication Data

US 2011/0006582 A1 Jan. 13, 2011

Related U.S. Application Data

(60) Provisional application No. 61/033,957, filed on Mar. 5, 2008.

(51) Int. Cl.

| | |
|---|---|
| *A47C 7/02* | (2006.01) |
| *A47C 7/14* | (2006.01) |
| *A47C 7/22* | (2006.01) |

(52) U.S. Cl. ..... 297/452.64; 297/219.1; 297/256.16; 297/452.13; 297/452.2; 297/452.23; 297/452.24; 297/452.56; 297/452.63; 297/DIG. 4; 297/284.2

(58) Field of Classification Search ..... 297/219.1, 297/256.16, 452.13, 452.2, 452.23, 452.24, 297/452.56, 452.63, 452.64, DIG. 4, 284.2
See application file for complete search history.

(56) References Cited

U.S. PATENT DOCUMENTS

| | | | | |
|---|---|---|---|---|
| 1,879,724 | A * | 9/1932 | Wolpert | 297/301.7 |
| 2,085,475 | A * | 6/1937 | Saives | 297/452.56 |
| 2,102,336 | A * | 12/1937 | Roe | 297/DIG. 4 X |
| 2,248,413 | A * | 7/1941 | Rathbun | 297/452.23 |

(Continued)

FOREIGN PATENT DOCUMENTS

JP 3100613 U 1/2004

(Continued)

OTHER PUBLICATIONS

International Search Report, Aug. 6, 2009.

*Primary Examiner* — Rodney B White
(74) *Attorney, Agent, or Firm* — Westman, Champlin & Kelly, P.A.; Z. Peter Sawicki

(57) ABSTRACT

In one aspect, a seat includes a perimeter frame and a weight bearing surface. The perimeter frame includes a front frame member, two contoured lateral frame members, and a contoured rear frame member. Each lateral frame member has a front portion, a second portion proximate the user's thighs, a concave curve portion proximate the user's pelvis, and a rear portion, the bottom of the concave curve portion being lower than the second portion and lower than the rear portion. The rear frame member has a central dip portion. The weight bearing surface on which the user sits includes a plurality of straps attached to the perimeter frame. Other aspects relate a method for making a seat and a method for fitting a seat to a user.

35 Claims, 13 Drawing Sheets

U.S. PATENT DOCUMENTS 2,821,245 A * 1/1958 Meneghelli ..... 297/452.2 X
2,865,436 A * 12/1958 Thorne ..... 297/440.11
2,934,134 A 4/1960 Adler
3,123,397 A * 3/1964 Murcott ..... 297/DIG. 4 X
3,131,971 A * 5/1964 Gunn ..... 297/452.2 X
3,538,522 A * 11/1970 Adams ..... 297/452.13 X
3,672,722 A * 6/1972 Murcott ..... 297/DIG. 4 X
3,711,156 A * 1/1973 Bloomfield ..... 297/452.13
3,887,228 A 6/1975 Ingerson
3,917,312 A * 11/1975 Rodaway ..... 297/DIG. 4 X
4,057,291 A 11/1977 Dubinsky
4,295,683 A * 10/1981 Dubbink et al. ..... 297/452.13 X
4,685,738 A * 8/1987 Tinus ..... 297/452.56 X
4,858,992 A * 8/1989 LaSota ..... 297/284.2
5,004,259 A * 4/1991 Ayers et al. ..... 297/DIG. 4 X
5,058,952 A * 10/1991 LaSota ..... 297/284.2
5,062,677 A * 11/1991 Jay et al. ..... 297/DIG. 4 X
5,074,620 A * 12/1991 Jay et al. ..... 297/DIG. 4 X
5,088,747 A * 2/1992 Morrison et al. ..... 297/219.1
5,106,152 A 4/1992 Ward, Sr. et al.
5,267,745 A * 12/1993 Robertson et al. ... 297/DIG. 4 X
5,457,833 A * 10/1995 Jay ..... 297/DIG. 4 X
5,549,357 A * 8/1996 Counts et al. ..... 297/DIG. 4 X
5,564,786 A * 10/1996 Peek et al. ..... 297/452.2 X
5,582,463 A * 12/1996 Linder et al. ..... 297/452.2
5,590,893 A * 1/1997 Robinson et al. .... 297/DIG. 4 X
5,645,321 A * 7/1997 Seroldi ..... 297/452.63
5,647,637 A * 7/1997 Jay et al. ..... 297/DIG. 4 X
5,671,977 A * 9/1997 Jay et al. ..... 297/452.24
6,015,394 A * 1/2000 Young ..... 297/DIG. 4 X
6,092,249 A 7/2000 Kamen et al.
6,352,307 B1 * 3/2002 Engman ..... 297/DIG. 4 X
6,357,776 B1 * 3/2002 Goertzen et al. ..... 297/DIG. 4 X
6,536,791 B1 3/2003 Adams
6,702,389 B2 * 3/2004 Hall et al. ..... 297/452.56
6,913,318 B2 * 7/2005 Higley et al. ..... 297/DIG. 4 X
7,052,080 B2 5/2006 Knight et al.
7,347,498 B2 3/2008 Clifford
7,374,189 B1 5/2008 Adams
7,540,568 B2 * 6/2009 Behrens et al. ..... 297/452.56 X
7,651,163 B2 1/2010 Jaskot et al.
7,703,850 B1 * 4/2010 Bell ..... 297/344.12
8,020,931 B2 9/2011 Frady
2006/0061164 A1 3/2006 Deans et al.

FOREIGN PATENT DOCUMENTS

KR 200250589 Y1 10/2001

* cited by examiner

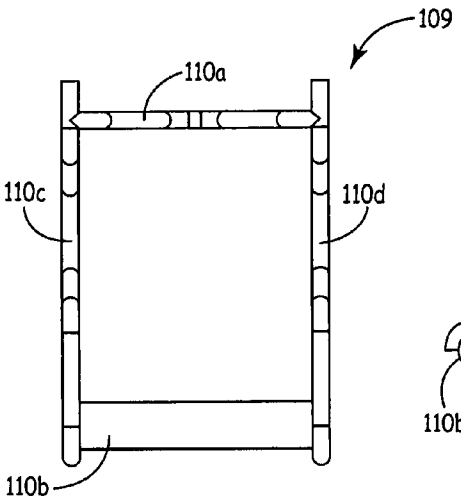
FIG. 4a
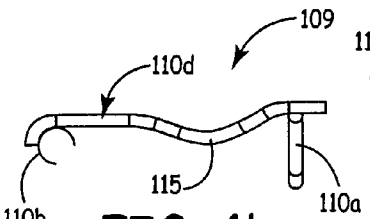
FIG. 4b
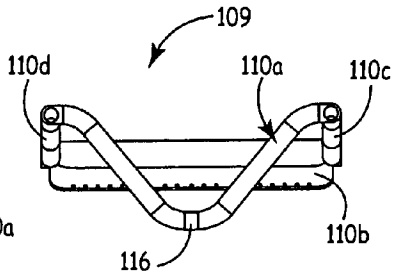
FIG. 4c
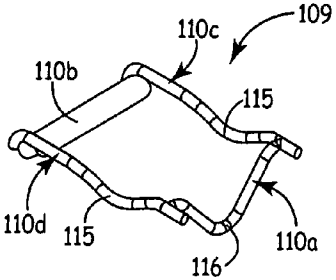
FIG. 4d
FIG. 4e
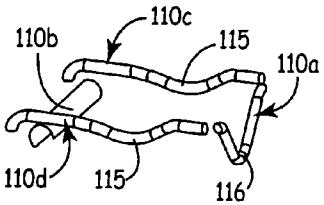
FIG. 4f

SEAT CUSHION

This Application is a Section 371 National Stage Application of International Application No. PCT/US2009/001404 filed Mar. 5, 2009 and published as WO 2009/111039 A1 on Sep. 11, 2009, the content of which is hereby incorporated by reference in its entirety.

FIELD OF USE

The present disclosure generally relates to a seating device for people. The device can be especially useful as a seat cushion for chairs and in particular for wheelchairs. In addition, the disclosure encompasses methods for custom fabricating and fitting a seat cushion for the user of a wheelchair.

BACKGROUND

Seats have a critical role in modem society. This is especially true of seating for wheelchairs. Especially for those users who must spend large amounts of time in a wheelchair, a seat (or "seat cushion" as it is commonly called) should achieve a number of objectives. First, it should maximize user function. This includes maximizing the user's ability to maneuver the chair and to engage in activities while in the chair. Second, the seat cushion should be comfortable for the user. Third, the seat cushion should be reliable and durable. Fourth, the seat cushion should be easy to clean and maintain. Finally, the seat cushion should be safe for the user.

Many aspects of wheelchair seat cushion design can simultaneously affect user comfort, function, and safety in the chair. For example, if a wheelchair user is not stable in the chair, the user likely will not be comfortable, will not have adequate function, and will not be safe.

When a user has decreased or absent sensation, a particular danger can be the formation of decubitus ulcers (commonly known as "pressure ulcers"). Decubitus ulcers are lesions that form on parts of the body that are in ongoing contact with objects such as beds or wheelchair seat cushions. The symptoms of decubitus ulcers range from skin redness (stage I) to "tunneling ulcers" with necrosis of the skin, fat, muscle and even bone (stage IV).

Wheelchair users can face a truly daunting (and even deadly) challenge in trying to prevent and manage decubitus ulcers. Decubitus ulcers can lead to hospitalization, plastic surgery, and even amputation. Once a patient has had an ulcer with skin scarring, the risk of future ulcers increases. Wheelchair users can face a repeating cycle of ulcer formation, hospitalization, surgery, and bed rest.

The repeated insult to the body, however, is only part of the affliction. Hospitalization and long-term bed rest can destroy families and social networks and severely hamper work and leisure. Costs incurred because of decubitus ulcers can be dramatic as well. In some cases, a single patient can incur ulcer-related medical costs that go well beyond one million dollars. Indirect costs such as lost productivity increase this monetary burden.

The general reason wheelchairs users face problems with decubitus ulcers is clear. Prolonged sitting in a wheelchair with no ability or limited ability to move the torso places tremendous cumulative loads on the body. The primary regions of the body affected are generally tissue near boney structures such as the sacrum, coccyx, ischial tuberosities (149*a*, 149*b* in FIGS. 2 and 3), and greater trochanters (147*a*, 147*b* in FIGS. 2 and 3). When "local factors" such as pressure, shear, heat, and moisture rise, the likelihood of ulcer formation increases.

Many developers of seat cushions have used various techniques to manage pressure to help prevent the formation of decubitus ulcers. Most developers in the past have focused on alleviating pressure. Typically, developers have tried to even out pressures across the entire area of the body in contact with the seat cushion. This might be described as "floatation."

Broadly speaking, seat cushions fit in two categories. The first category includes custom seat cushions. The most sophisticated custom seat cushions are made by taking an impression of the intended user, making a mold from the impression, and using the mold to fabricate the seat cushion. The material used for the seat cushion is typically foam. In some cases, the seat cushion can have a monolithic foam component. In other cases, a less sophisticated seat cushion can be constructed from foam components pieced together.

The second category of seat cushions is non-customized, or "standardized," cushions. These seat cushions can range from non-sophisticated seat cushions that have limited capacity to adjust to a user's anatomy to seat cushions that can be adjusted or adjust automatically in response to phenomena such as pressure on the seat cushion's weight bearing surface. The more sophisticated, adjustable seat cushions can include ones made of materials such as foams with special properties that adapt based on pressure or heat or ones with pneumatic systems that use air in compartments to create an adjustable weight bearing surface.

Other non-customized seat cushions use a liquid to achieve "floatation" or "equalization." One such seat cushion is the "Jay® cushion." It uses a high viscosity liquid positioned in cells or reservoirs underneath a user's boney prominences. There are also "dynamic" cushions. Dynamic cushions have cells that alternately fill changing supportive locations. One example is the "Aquila" seat cushion from Aquila Corporation of La Crosse, Wisconsin.

The prior art suffers from certain shortcomings or limitations, many of which are identified in the text below. The purpose of the device and method of the present disclosure is to overcome the shortcomings or limitations in the prior art.

SUMMARY

In one aspect, a seat comprises a perimeter frame and a weight bearing surface. The perimeter frame comprises a front frame member, two contoured lateral frame members, and a contoured rear frame member. Each lateral frame member has a front portion, a second portion proximate the user's thighs, a concave curve portion proximate the user's pelvis, and a rear portion, the bottom of the concave curve portion being lower than the second portion and lower than the rear portion. The rear frame member has a central dip portion. The weight bearing surface on which the user sits comprises a plurality of straps attached to the perimeter frame.

In another aspect, a method of making a seat comprises weaving a plurality of flexible straps into a weight bearing surface and securing each of the straps onto a contoured perimeter frame, placing a pelvic form on the weight bearing surface; and adjusting one or more straps to conform the weight bearing surface to the pelvic form. The perimeter frame comprises a front frame member; two contoured lateral frame members, and a contoured rear frame member having a central dip portion. Each lateral frame member has a downward curving front portion, a substantially straight second portion proximate the user's thighs, a concave curve portion proximate the user's pelvis, and a substantially straight rear portion, the bottom of the concave curve portion being lower than the second portion and lower than the rear portion.

In yet another aspect, a method of fitting a seat to a user comprises providing a seat, seating the user on the weight bearing surface; and adjusting one or more straps to conform the weight bearing surface to the user, thereby forming a pelvic recess in the weight bearing surface. The seat comprises a perimeter frame and a weight bearing surface on which the user sits. The perimeter frame comprises a front frame member; two contoured lateral frame members; and a contoured rear frame member having a central dip portion. Each lateral frame member has a downward curving front portion, a substantially straight second portion proximate the user's thighs, a concave curve portion proximate the user's pelvis, and a substantially straight rear portion, the bottom of the concave curve portion being lower than the second portion and lower than the rear portion. The weight bearing surface comprises a plurality of woven flexible straps having voids therebetween, wherein each strap is adjustably attached to the perimeter frame.

This Summary is provided to introduce concepts in simplified form that are further described below in the Detailed Description. This Summary is not intended to identify key features or essential features of the disclosed or claimed subject matter, and is not intended to describe each disclosed embodiment or every implementation of the disclosed or claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

FIGS. 4*a*-4*f* are respectively, top, side, rear, front, isometric, and exploded isometric views of perimeter frame members for the seat cushion of FIG. 1.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. Moreover, where terms such as above, below, over, under, top, bottom, side, right, left, etc., are used, it is to be understood that they are used only for ease of understanding the description. It is contemplated that structures may be otherwise oriented.

DETAILED DESCRIPTION

The disclosure is directed to a device with a weight bearing surface that can be used, for example, as a wheelchair seat cushion. In one embodiment, the seat comprises a rigid, contoured perimeter frame from which webbing is suspended. The webbing forms the weight bearing surface on which the user of the wheelchair sits. In at least one embodiment, the webbing can be made of woven straps. The length of one or more of the straps suspended in the perimeter frame is adjustable. This allows for easy creation of depressions when weight is placed on the webbing. Depressions and contours on the weight bearing surface can also be made more or less pronounced by contouring of the perimeter frame.

In other aspects, the disclosure is directed to methods for custom fabricating and fitting a seat cushion for a user. One method, for example, can involve custom fabricating and fitting a seat cushion. The method can also involve the use of reusable pelvic forms that represent a "standard shape" to make the initial adjustment to a seat cushion based on data gathered on past users and the intended user. This method can also involve a fitting in which the fitter can assess pressure on the underside of the weight bearing surface by sight or touch.

Figure 1:
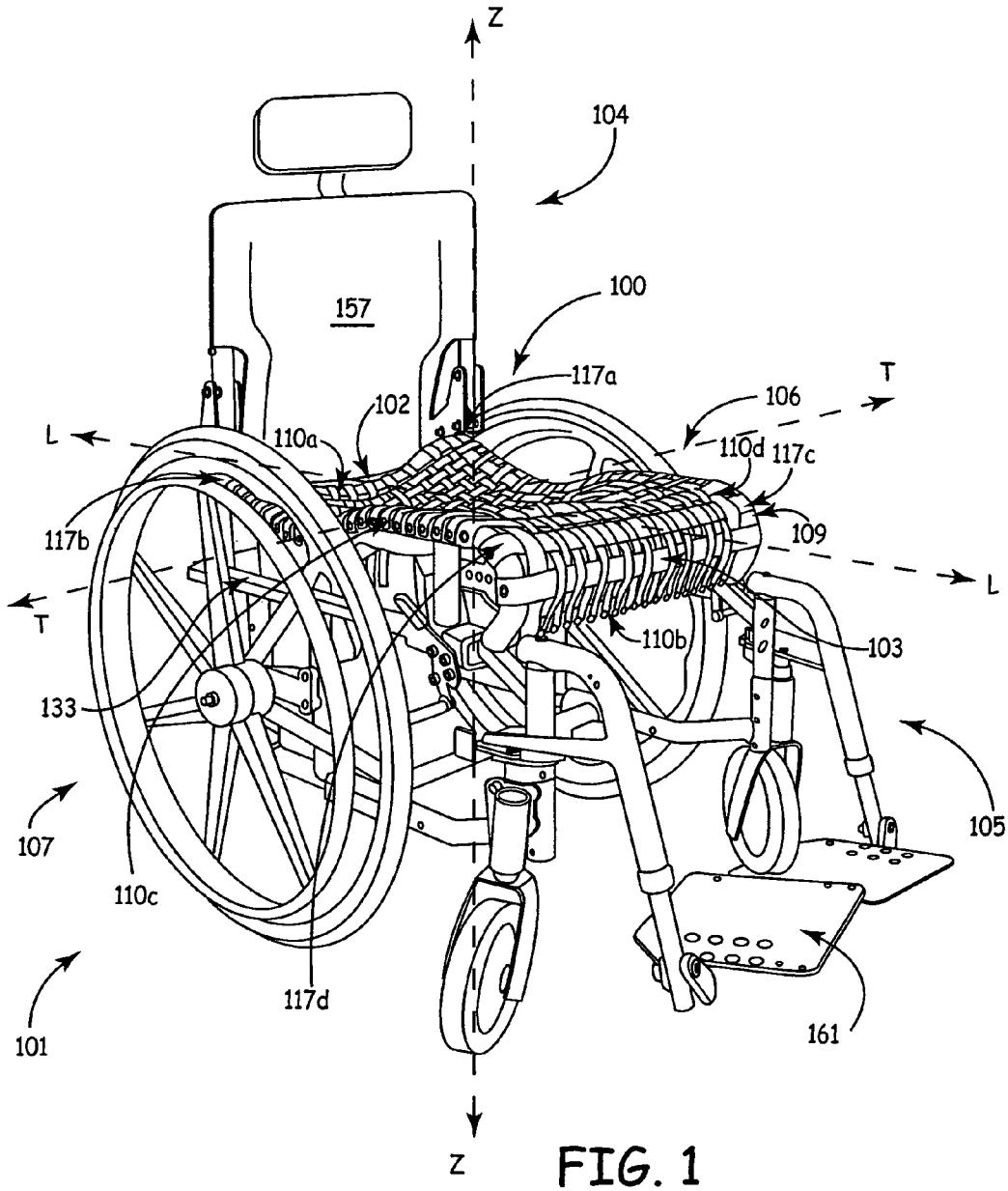
FIG. 1 is a perspective view of a wheelchair having first embodiment of a seat cushion.

FIG. 1 shows a wheelchair 101 with the seat cushion 100. The wheelchair 101 has a rear 102, a front 103, a top 104, a bottom 105, a left side 106 and a right side 107 (from the viewpoint of a wheelchair user 108, shown in FIG. 2, sitting in the wheelchair 101).

The wheelchair 101 and the seat cushion 100 shown in FIG. 1 are oriented with a longitudinal line L. The term "longitudinal" refers to a line, axis, or direction in the plane that is substantially aligned with the line L. The length of the wheelchair 101 or seat cushion 100 is its maximum dimension measured parallel to line L.

The wheelchair 101 shown in FIG. 1 can further be oriented with a transverse line T that is perpendicular to the longitudinal line L. The term "transverse" refers to a line, axis, or direction in the plane of the wheelchair 101 or seat cushion 100 that is substantially aligned with the line T. The width of the wheelchair 101 or seat cushion 100 is the maximum dimension measured parallel to line T.

The wheelchair 101 or seat cushion 100 can further be oriented with a line Z, which is perpendicular to the plane formed by lines L and T and generally corresponds to the direction associated with the height dimension of the wheelchair 101 or seat cushion 100. The height of the wheelchair 101 or seat cushion 100 is the maximum dimension measured parallel to the longitudinal line Z.

When a range or interval is disclosed, the disclosure is intended to disclose both the endpoints and the intervals within the range. For example, a range of 0.005 to 0.010 includes 0.005, 0.006 and 0.010 within that range.

Figure 5:
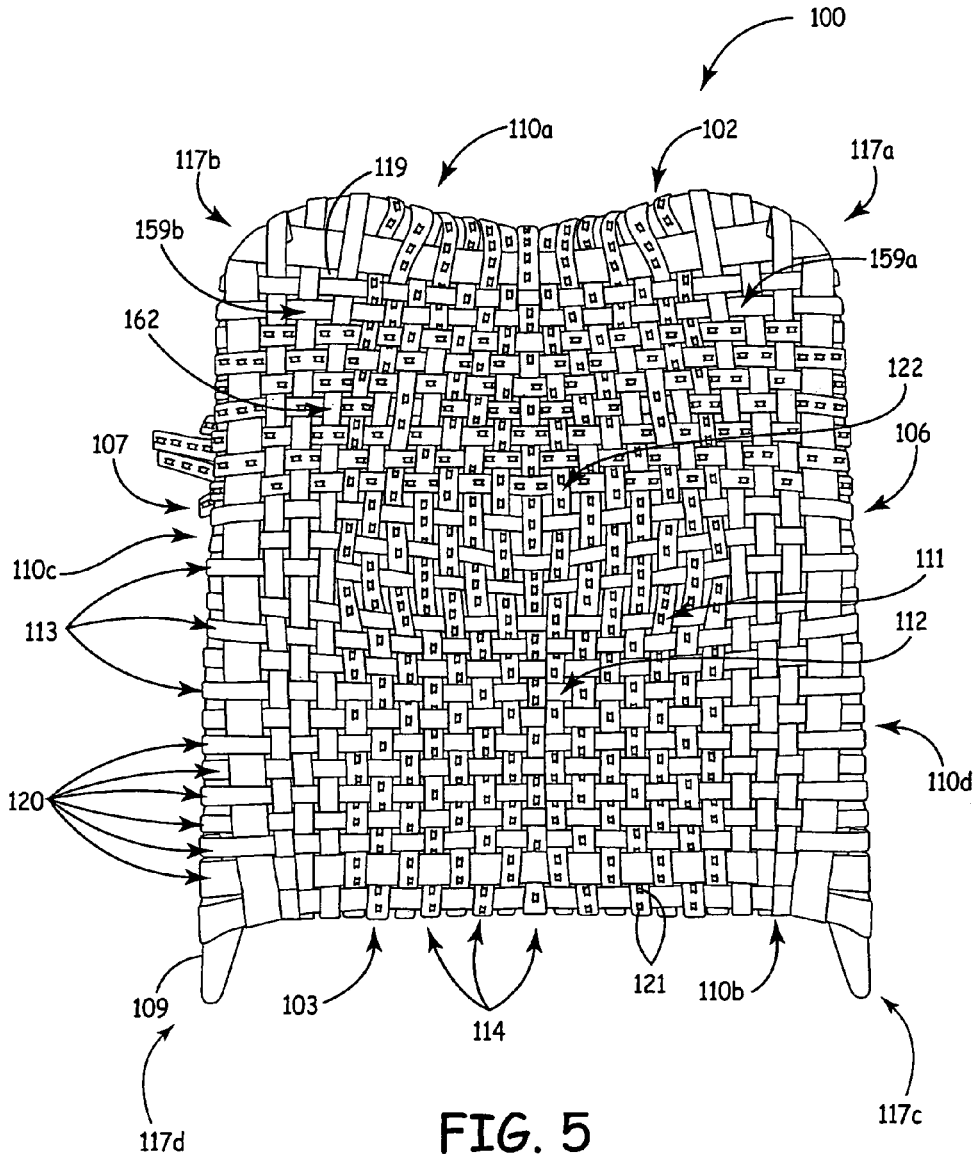
FIG. 5 is a plan view of the seat cushion of FIG. 1.

FIGS. 1 to 12 show a first exemplary embodiment of a wheelchair 101 with a seat cushion 100. The seat cushion 100 generally comprises a perimeter frame 109 with webbing 111 suspended on the frame 109. As shown in FIG. 4, the perimeter frame 109 has members 110*a*, 110*b*, 110*c*, 110*d* that are contoured are preferably substantially rigid. The webbing 111 forms the weight bearing surface 112 for the user 108 of the chair (shown in FIG. 2). As shown in FIG. 5, in one embodiment, the webbing 111 is made of orthogonally intersection transverse straps 113 and longitudinal straps 114. The straps 113, 114 are loosely woven, i.e., not attached to each other, forming a plurality of voids therebetween. The pattern for the straps 113, 114 is a "plain weave" (also know as a "tabby weave") where, for example, a transverse strap 113 is woven over-and-under succeeding longitudinal straps 114. In an exemplary embodiment, the straps 113, 114 are adjustable, thereby allowing for change in the contours of the weight bearing surface 112 when a user 108 sits on the seat cushion 100.

As discussed more fully below, the seat cushion 100 can be custom fabricated for a particular user 108. A "fitter" can be involved at various steps including making adjustments after fabrication to ensure the seat cushion 100 fits the user 108 properly. The term "fitter" can include any person who helps fit the seat cushion 100. It is preferable, as discussed below, that the fitter is a specialist who may need certification to be qualified to fit the seat cushion 100.

The Frame

As shown in FIGS. 4*a*-4*f*, perimeter frame members 110*a*, 110*b*, 110*c*, 110*d* form the perimeter frame 109 structure from which the webbing 111 transverse straps 113 and longitudinal straps 114 are suspended. In an exemplary embodiment, the perimeter frame 109 has a substantially rectangular configuration as shown in FIGS. 4 and 5 (although the rear corners 117*a*, 117*b* can be more curved than shown). This configuration allows for the creation of a substantially rigid frame 109 that performs consistently through repeated use cycles. In an exemplary embodiment, front frame member 110*b* is a cylinder or a partial cylinder and each of the lateral 110*c, d* and rear 110*a* frame members is tubular.

Figure 2:
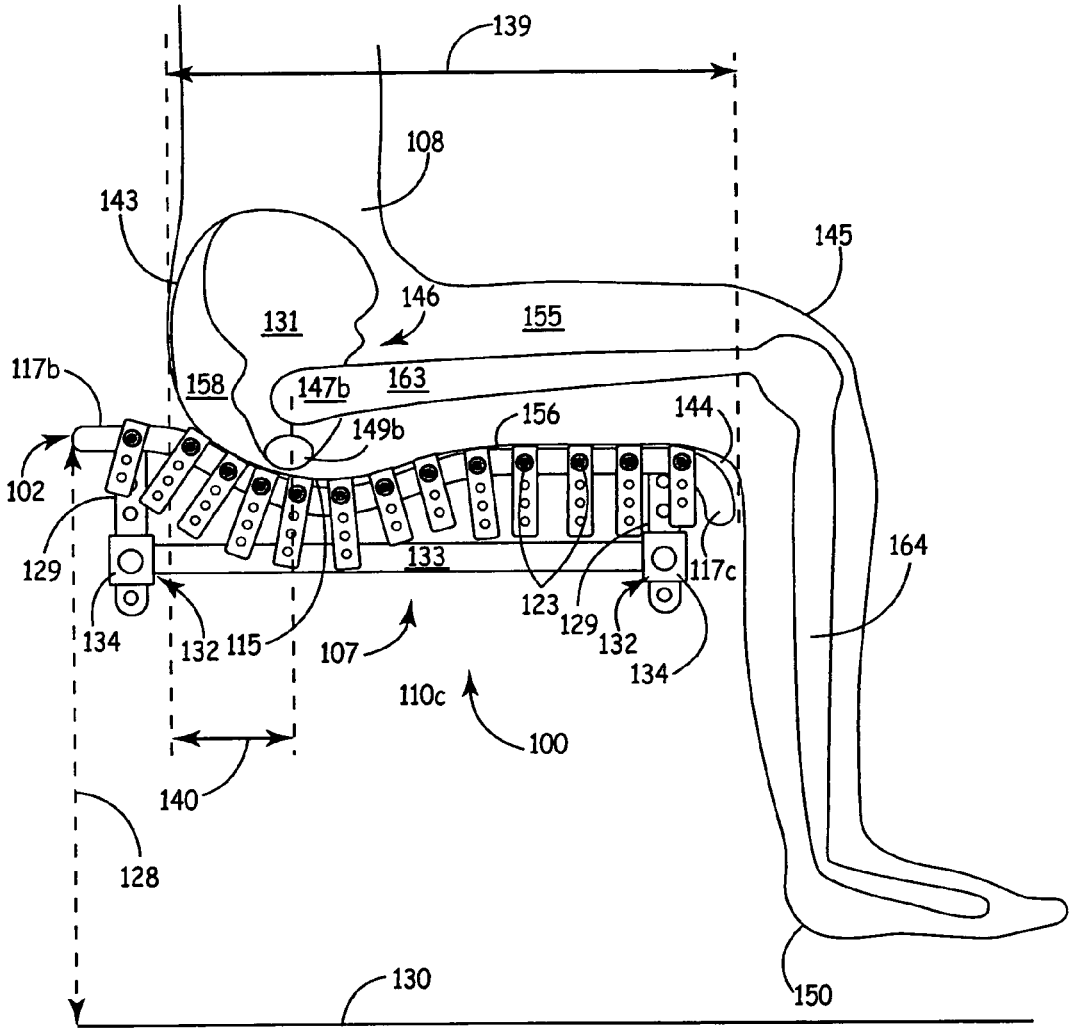
FIG. 2 is a side elevation view of a wheelchair user seated in the seat cushion of FIG. 1.
Figure 11:
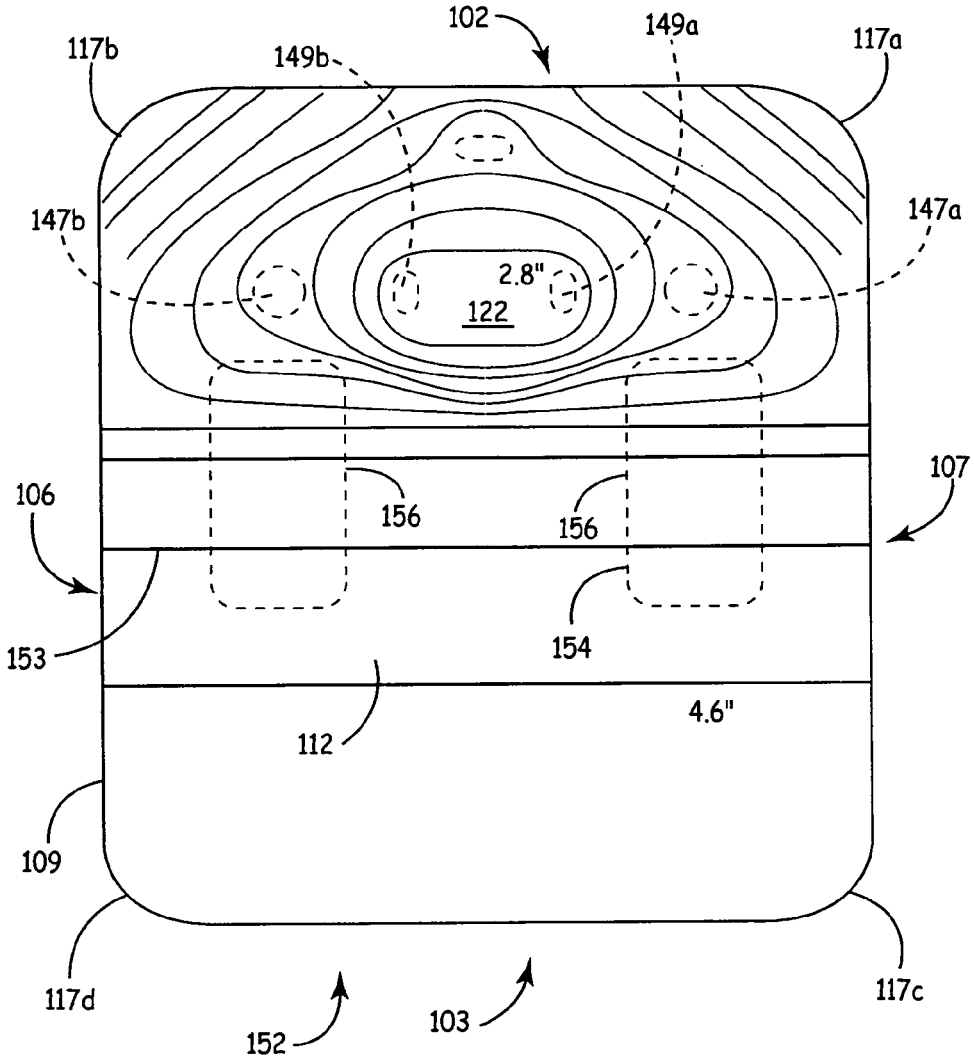
FIG. 11 is an exemplary topographic map of the weight bearing surface of the seat cushion.

In an exemplary embodiment, the lateral contoured perimeter frame members 110*c*, 110*d* as shown in FIGS. 1 and 2 form mild "s-curves" in planes parallel to the L-Z plane. When positioned on a wheelchair 101, the lateral perimeter frame members 110*c*, 110*d* have a downward curving front portion, a substantially straight second portion proximate the user's thighs 155, a concave curve portion or depression 115 proximate the user's pelvis 131, and a substantially straight rear portion, as shown in FIGS. 2 and 11. In an exemplary embodiment, the bottom of depression 115 is lower than the second portion and lower than the rear portion. Depression 115, as well as the adjustment of the length of the straps 113, 114, contributes to proper weight and pressure distribution.

Figure 3:
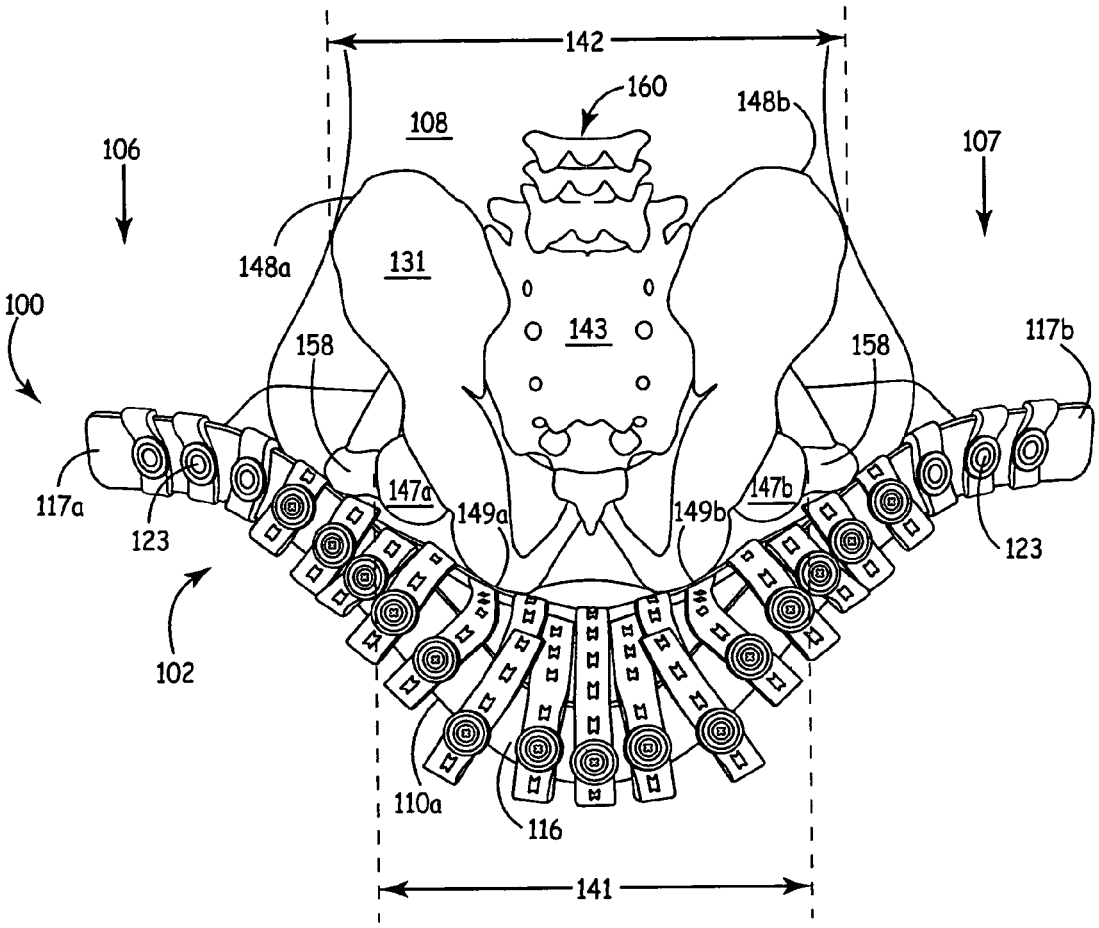
FIG. 3 is a rear elevation view of a wheelchair user seated in the seat cushion of FIG. 1

In an exemplary embodiment, the rear perimeter frame member 110*a* has a central dip portion as shown in FIGS. 1 and 3 shaped like an inverted bell curve in a plane substantially parallel with the T-Z plane. Thus, when positioned on a wheelchair 101, the contour of the rear perimeter frame member 110*c* can have a depression 116 in the middle with higher portions at the rear corners 117*a*, 117*b*. Depression 116, as well as the adjustment of the length of the straps 113, 114, contributes to proper weight and pressure distribution.

In an exemplary embodiment, the front perimeter frame member 110*b* generally has limited contour in the T-Z plane. In an exemplary embodiment, the front perimeter frame member 110*b* has a curved front edge as shown in FIG. 2. The curved front edge provides a smooth surface against which the popliteal area 144 of the wheelchair 101 user's 108 knee 145 may rest.

The perimeter frame members 110*a*, 110*b*, 110*c*, 110*d* can be formed or joined to each other in different ways. FIG. 4 shows one way. The perimeter frame members 110*a*, 110*b*, 110*c*, 110*d* can be made of different materials and formed in different ways. In an exemplary embodiment, it is preferable that the perimeter frame members 110*a*, 110*b*, 110*c*, 110*d* form a rigid perimeter frame 109. Suitable materials include, for example, injection molded or thermoformed plastics such as acrylonitrile butadiene styrene (ABS) or formed metals such as aluminum or steel. For certain applications in which material costs can be higher, materials such as carbon fiber or even titanium can be used. For other applications where material costs need to be kept low, other materials may be appropriate.

The frame 109 can be constructed with other frame elements (not shown) in addition to the perimeter frame members 110*a*, 110*b*, 110*c*, 110*d*. Additional frame elements can provide additional bracing or support or can make attachment of the seat cushion 100 to the wheelchair 101 easier.

The Webbing

The webbing 111 in this embodiment can comprise straps 113, 114 suspended on the perimeter frame 109 as shown in FIGS. 1-3 and 5-7. As mentioned, the straps 113, 114 can be interlaced in a plain weave with the straps 113, 114 intersecting at approximately ninety degrees at most locations on the weight bearing surface 112. Many other weave patterns are possible.

In an exemplary embodiment, straps 113, 114 are not attached to each other in order to facilitate easy movement of the straps 113, 114 relative to each other. However, in certain locations it can be advantageous to restrict the movement of the straps 113, 114 relative to each other. This can be done, for example, in order to prevent openings 119 formed between the straps 113, 114 from enlarging. For attachment, straps 113, 114 can be sewn or spot welded to each other (not shown). Alternatively, it is possible to restrict movement of straps 113, 114 relative to each other by using, for example, loops (not shown) or other methods to limit sliding of the straps 113, 114 in one direction but not another.

The straps 113, 114 (or the webbing 111 more generally) can be made of a variety of materials. It is preferable that the straps 113, 114 behave consistently over an extended period in a variety of conditions including heat, cold, and high moisture, for example. For most applications, the straps 113, 114 are flexible but substantially elongationally inelastic (or their elasticity should be predictable through the course of many use cycles). Thus, when an adjustment or fitting is done for a particular user 108, the configuration (including the contours) and performance of the seat cushion 100 can remain relatively consistent for an extended period.

The straps 113, 114 have sufficient tensile modulus to support the wheelchair user 108 over an extended time and in a variety circumstances. For some larger users 108, straps 113, 114 with a greater tensile modulus may be necessary. In some instances, it may be desirable to have straps 113, 114 with different tensile moduli at different locations on the weight bearing surface 112. For example, it may be desirable to have certain transverse straps 113 near the front 103, such that straps 120 shown in FIG. 5 have greater tensile moduli than other transverse straps 113. This might especially be true for seat cushions 100 fabricated for paraplegic users 108 who may place a hand (not shown) near the front 103 of the seat cushion 100 for advantage when transferring in and out of the wheelchair 101.

The exterior surfaces of the straps 113, 114 can have coefficients of friction (COF) intended to achieve certain objectives. Low COFs can permit the straps 113, 114 to slide easily relative to each other when weight is placed on the weight bearing surface 112. This can ensure that each time a user 108 sits, leans, twists, or otherwise moves on the seat cushion 100, the seat cushion 100 assumes the proper configuration of support for the user's 108 pelvis and legs. Straps 113, 114 with exteriors having high COFs may grip each other and not provide consistent characteristics when the occupants sits on the seat cushion 100.

In an exemplary embodiment, the straps 113, 114 are impervious to moisture and contaminants. Having straps 113, 114 with low absorbency also makes cleaning the straps 113, 114 easier. Suitable materials for the straps 113, 114 can include polyester, nylon, or Kevlar®, for example. For many applications, a preferable material is polypropylene, which has a relatively high tensile modulus, dimensional stability, and low absorbency.

Figure 7:
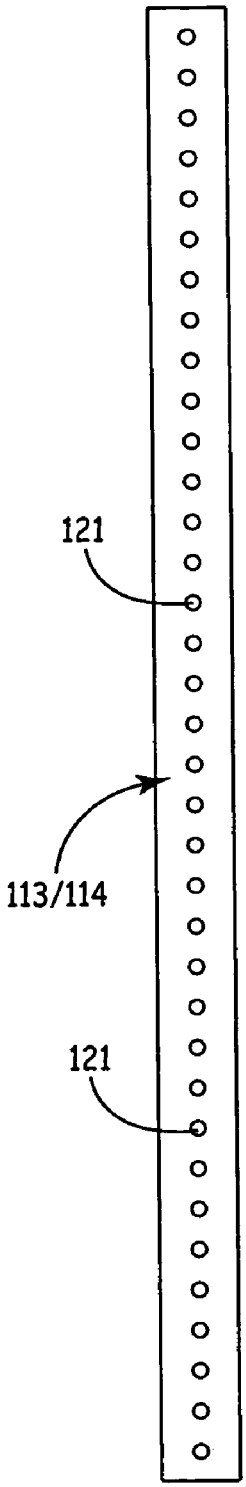
FIG. 7 is a plan view of an exemplary embodiment of a strap.

Many other kinds of strap materials may also be appropriate. Straps 113, 114 may include metallic components or can even be made of wire or metal fabric. Reinforcing with metallic threads for additional strength may also be appropriate. Straps 113, 114 can have a laminate construction, coatings, and so forth. Straps 113, 114 can have holes 121 for securement to the perimeter frame members 110*a*, 110*b*, 110*c*, 110*d* and for added ventilation. Holes 121 may have different shapes, as shown in FIGS. 5 and 7.

For most applications, flat straps 113, 114 having a rectangular shape may be most suitable. However, many other shapes may be appropriate. Moreover, the webbing 111 may be made of cords, strings, threads, or even filaments, rather than straps.

The length and width of the straps 113, 114 can depend on many factors. Strap length can largely depend on the size of the perimeter frame of the seat cushion 100. The length should be sufficient to span the perimeter frame 109 and to permit adjustment, including the creation of contours in the weight bearing surface 112 that help achieve the desired pressure transfer. Similarly, the width of the straps 113, 114 can be varied. Having a greater number of narrower straps 113, 114 can increase the precision of the adjustments made to the straps 113, 114 and hence the shape of the weight bearing surface 112. For example, the disclosure contemplates having half-inch wide straps 113, 114. However, having more straps 113, 114 can also increase the number of adjustments to accommodate a user 108.

In an exemplary embodiment, the straps 113, 114 are configured on the perimeter frame members 110*a*, 110*b*, 110*c*, 110*d* as follows. The transverse straps 113 are spaced apart and suspended from the lateral perimeter frame members 110*c*, 110*d*. The longitudinal straps 114 are spaced apart and suspended from the rear perimeter frame member 110*a* and the front perimeter frame member 110*b*.

With this method, the "active length" of the straps 113, 114 can be adjusted. "Active length" for this embodiment means the length of the strap 113 between two attachment points on opposing frame members 110*a*, 110*b*, 110*c*, 110*d*. It also means that part of the strap 113 that fowls part of the weight bearing surface 112. By extending or shortening the active length of the straps 113, 114, the contours of the weight bearing surface 112 can be altered. For example, by lengthening or shortening the active length of certain straps 113, 114, depressions can easily be formed when weight is placed on the weight bearing surface 112—such as when a user 108 sits on the seat cushion 100. For example, certain straps 113, 114 can be loosened such that when the user 108 sits on the seat cushion 100, a "pelvic recess" 122 can be formed, as shown in FIG. 1.

Strap Fixtures

Figure 6:
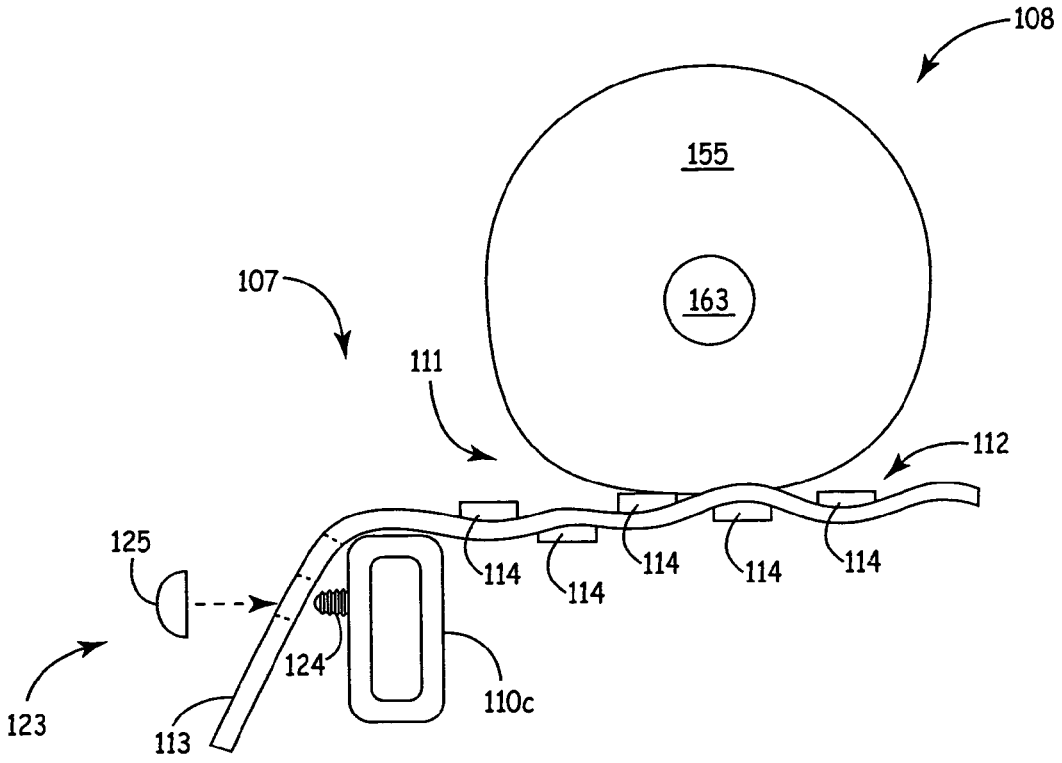
FIG. 6 is a front, elevation, sectional view of an exemplary right lateral perimeter member and the right thigh of the wheelchair user.

The straps 113, 114 can be attached to the perimeter frame members 110*a*, 110*b*, 110*c*, 110*d* in a variety of ways. An exemplary method is shown in FIGS. 5-7. Strap fixtures 123 are mounted to the perimeter frame members 110*a*, 110*b*, 110*c*, 110*d*. In an exemplary embodiment, the strap fixtures 123 have a post 124 and a retainer 125 that resists unintentional dislodgement, as shown in FIG. 6. The retainer 125 screws on or attaches in other ways to the post 124. The post 124 fits into the holes 121 in the straps 113, 114. An another embodiment, an end of a strap 113, 114 is attached back onto the strap.

Figure 8:
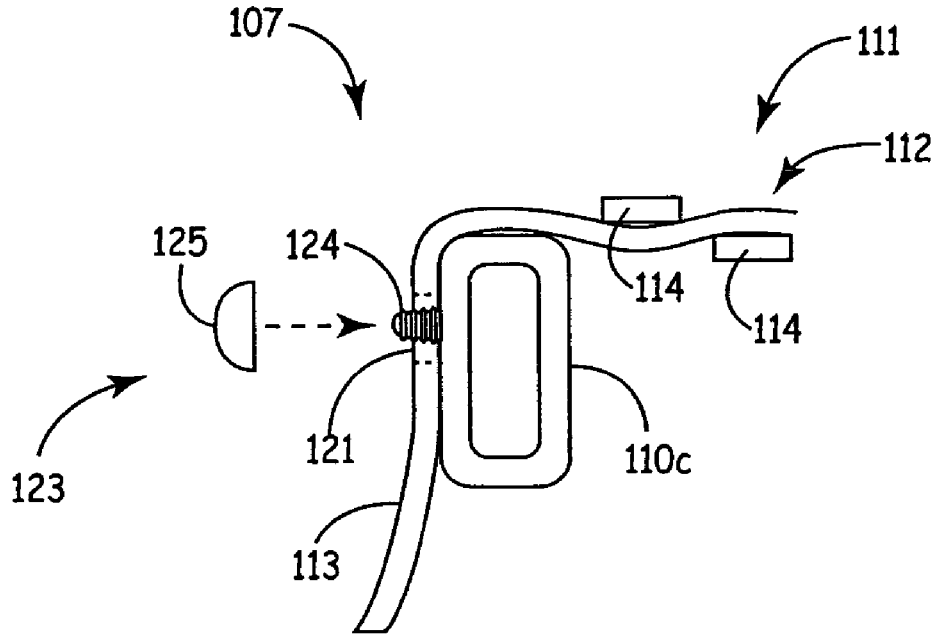
FIG. 8 is a front, sectional, elevation view of the lateral perimeter member of FIG. 6

As shown in FIG. 8, in an exemplary embodiment, the frame 109 and strap fixtures 123 are configured such that the straps 113, 114 can be provisionally secured to the post 124 during a fitting of a seat cushion 100 without use of the retainer 125. This allows rapid adjustment of the straps 113, 114 during a fitting. Once a fitting has been completed and the desired active length has been found, the retainer 125 can be releasably locked onto the post 124 to secure the straps 113, 114 in a desired position.

Many other strap fixtures 123 and ways to adjust the length of the straps 113, 114 that form the weight bearing surface 112 are also possible. For example, various kinds of ratcheting mechanisms (not shown) can adjust the length of the straps 113, 114. Various fasteners (not shown) including clamps, buckles, hook and loop fasteners and so forth can be used to secure the straps 113, 114 in place.

Figure 9:
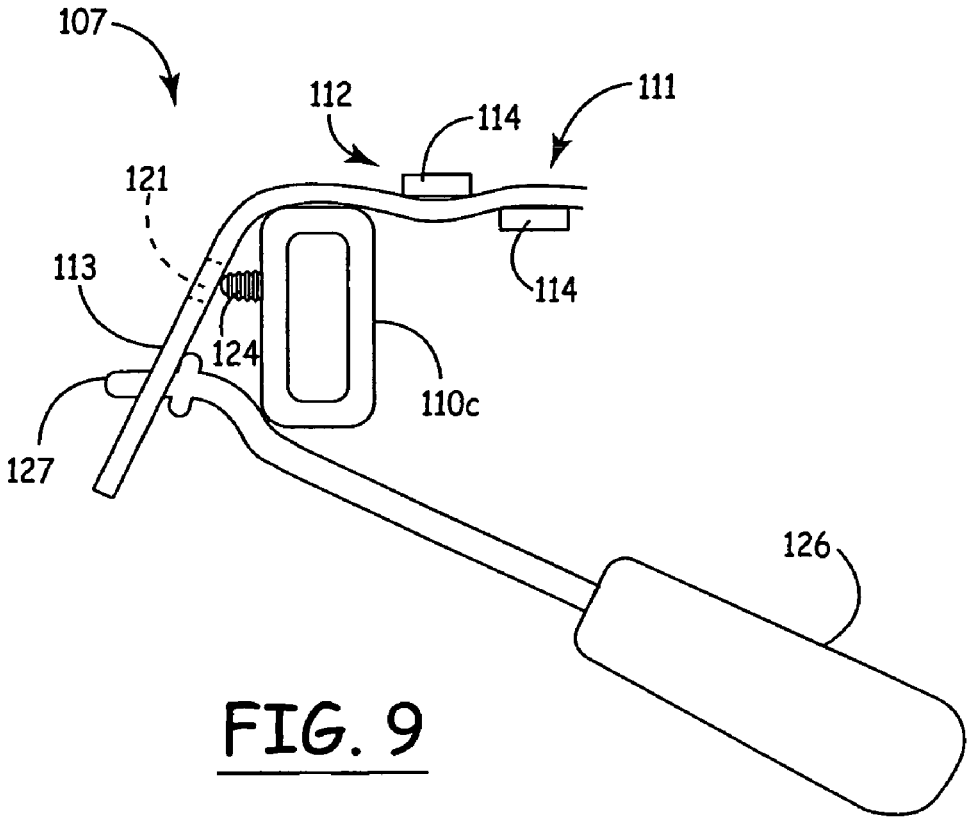
FIG. 9 is a front, elevation, sectional view of the lateral perimeter member of FIG. 6 and a lever tool.

The configuration of the straps 113, 114 can also be such that the straps 113, 114 can be loosened or tightened when the straps 113, 114 are loaded, e.g., with a user 108 sitting on the seat cushion 100. In some instances, especially where the load on the straps 113, 114 is minimal, the strap 113 can be pulled down and away from the frame member 110*c* as shown in FIG. 6 to pull the strap 113 off the post 124 for adjustment of the strap 113. This can be made easier by using the top portion of the perimeter frame member 110*c* as a fulcrum. Alternatively, as shown in FIG. 9, a lever tool 126 with a tip 127 can be inserted in one of the holes 121 and can be used to lift the strap 113 away from the perimeter frame member 110*c* and advance the strap 113 to the next hole 121.

Seat Cushion Cover

Figure 12:
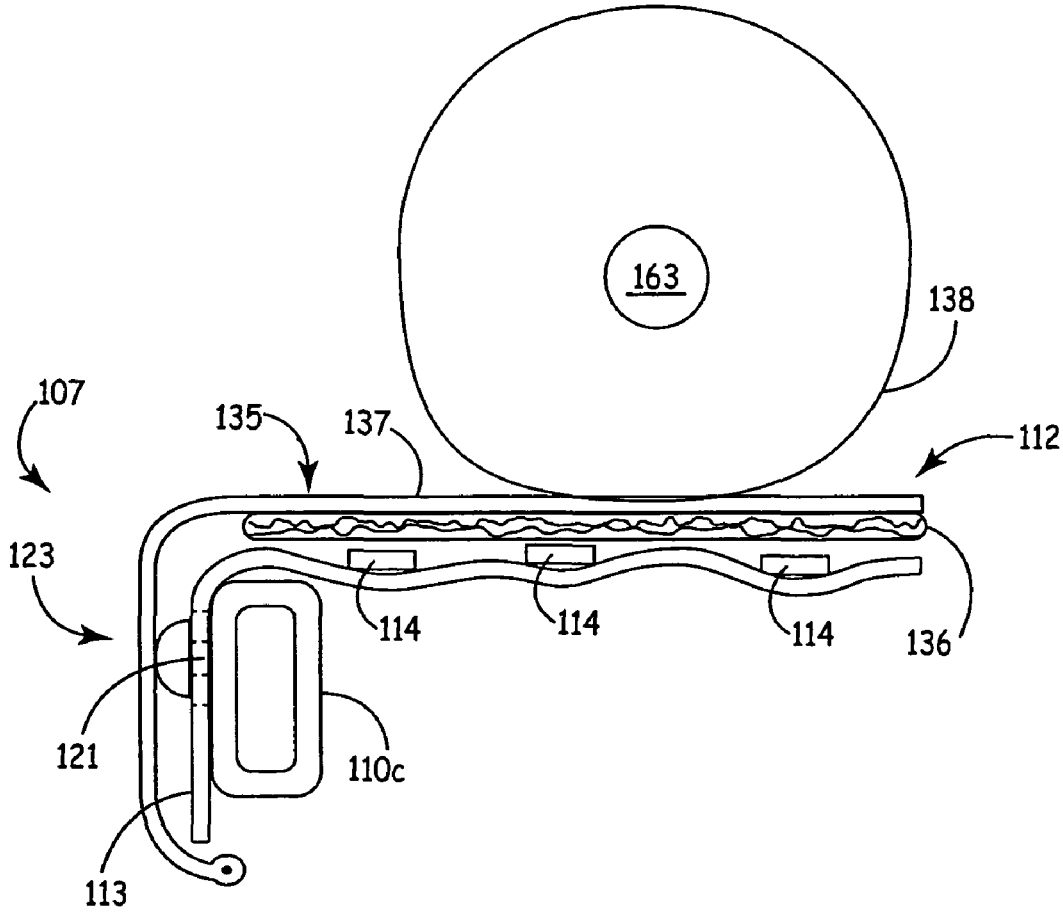
FIG. 12 is a front elevation, sectional view of an exemplary cover.

In an exemplary embodiment, the seat cushion 100 has a cover 135, a portion of which is shown in FIG. 12. The cover 135 may fit over the entire frame 109 and weight bearing surface 112. The cover 135 may have various layers. In an exemplary embodiment, one layer is a pad 136. The pad 136 provides some additional cushioning and spreads the load from the wheelchair user 108 among the straps 113, 114. One suitable material for the pad 136 is a polyester reticulate-fiber material. Such a material is flexible and durable. The interstices of such a reticulate fiber maintain ventilation. Moreover, the reticulate fibers can be non-absorbent, making the pad easy to clean. Many other materials can also be used for the pad 136.

In an exemplary embodiment, an outer layer 137 covers the pad 136 and is made of a fabric with a low COF. This ensures that the outer layer 137 does not "grab" the skin 138 of the wheelchair user 108 in such a way that increases shear forces. A suitable material for the outer layer 137 includes Lycra® from DuPont, which is not absorbent and easy to clean. Many other materials may be suitable for the outer layer 137. The term "seat cushion" as used herein does not imply that the seat is necessarily soft. Seat cushion 100 can be firm even if seat cushion cover 135 or pad 136 is used.

A method can be used to custom fabricate and fit the seat cushion 100 described in relation to FIGS. 1 to 12. As used here, custom fabrication can mean that at least some components of the seat cushion 100 are fabricated by a fabricator (e.g., the manufacturer or another person) specially for a particular wheelchair user 108 or for a particular wheelchair 101. Custom fitting as used here can mean adjusting the seat cushion 100 mounted on the wheelchair 101, typically with the user 108 providing feedback regarding fit.

The exemplary method of fabrication and fitting discussed here can involve a relatively high degree of customization. The method also can involve customization by different persons with different levels of skill, although for most applications it is preferable to have specialists doing the fabrication. Specialized manufacturing and fitting equipment can be used at various steps. For a seat cushion 100 that involves less custom fabrication and fitting, some of these steps can be eliminated.

The Custom Fabrication Process

One step in an exemplary custom fabrication process (useful for both fabrication and fitting) is collecting user profile data from the intended user 108 of the seat cushion 100. User profile data includes gender, weight, kind of disability, and other potential background information, for example. User profile data also includes the wheelchair model to which the seat cushion 100 is to be attached. Moreover, the data may include measurements of certain parts of the anatomy of the intended user 108.

The anatomical measurements preferably will be taken by a specialist. Specialists who might assist in taking these measurements might include one or more of the following: occupational therapists (OT), physical therapists (PT), a certified Rehabilitation Technology Supplier (RTS), an Assistive Technology Supplier (ATS), an Assistive Technology Practitioner (ATP), or a Rehabilitation Engineering Technologist (RET).

It may be preferable that the specialist taking the anatomical measurements have training in taking the measurements required for fabricating and fitting the seat cushion 100. It also may be preferable to have the person taking the measurements be the same person who conducts fitting, referred to here as the "fitter."

A first anatomical measurement 139 can be taken from the sacral region 143 to the popliteal region 144 of the knee 145 as shown in FIG. 2. The measurement 139 can be taken when the user 108 is sitting (or recumbent, with hips 146 and knees 145 flexed to 90°). The measurement 139 can be useful for determining the length of the seat cushion 100.

A second anatomical measurement 140 can be taken from the sacral region 143 to the front (distal aspect) of the greater trochanters 147*a*, 147*b* as shown in FIG. 2. The measurement 140 can be taken when the user 108 is sitting (or recumbent, with hips 146 and knees 145 flexed to 90°). The measurement 140 can be useful for determining the position of the pelvic recess 122 on the weight bearing surface 112 and, in particular, the location at which the pelvic recess 122 should begin to rise toward the front 103 of the seat cushion 100. It can also be referred to as the "sacral-greater trochanter" measurement 140.

A third anatomical measurement 141 can be the distance between the lateral aspects of each greater trochanter 147*a*, 147*b* as shown in FIG. 3. The measurement 141 can be taken when the user 108 is sitting (because the tissue may spread). The measurement 141 can be useful for determining the width of the seat cushion 100.

A fourth anatomical measurement 142 can be from the left anterior superior iliac spine (ASIS) 148*a* to the right ASIS 148*b*. The measurement 142 can be taken when the user 108 is positioned as shown in FIG. 3. The measurement 142 can be useful for approximating the distance between the lateral aspects of the ischial tuberosities 149*a*, 149*b* and hence the location on the seat cushion 100 at which the pelvic recess 122 should begin to rise toward the left and right sides of the seat cushion 100. It can also be referred to as the "ASIS span" measurement 142.

Other measurements can also be taken. For example, it may be desirable to have a fifth anatomical measurement (not shown) of the distance from the popliteal region to the bottom of the heel 150 while the user 108 is sitting. Such a measurement can be useful in estimating the seat-to-floor height 128 (and the position of the footrest 161 of the wheelchair 101) and in making an initial adjustment of the attachment hardware 132 for attaching the seat cushion 100 to the wheelchair 101. Still other measurements can include the elbow (not shown) to weight bearing surface 112 and the weight bearing surface 112 to the top of the head (not shown).

For certain wheelchair users 108, the measurements mentioned above may need alteration. For example, a wheelchair user 108 may have an asymmetrical pelvis 131 or may have a dislocated hip 146. For such users 108, measurements may need to be adapted or special measurements may need to be taken.

Various kinds of instruments can be used for taking these measurements. For many applications, a flexible ruler such as a tape measure (not shown) can be used. For other applications, other instruments can be used.

Using the measurements described above, another step can be the custom fabrication of the width and length of the frame 109 for the intended user 108. This is typically done by the manufacturer of the seat cushion 100. The length of the seat cushion 100 can be based on the seat length measurement 139. The width of the seat cushion 100 can be based on the seat width measurement 141. Moreover, the width of the seat cushion 100 should also fit within the confines of the wheelchair 101. Custom fabrication of the seat width and length are typically done at the factory before shipment. Custom fabrication of the seat width and length can involve providing perimeter frame members 110*a*, 110*b*, 110*c*, 110*d* of different lengths.

Some wheelchair models may require frame members 110*a*, 110*b*, 110*c*, 110*d* to be configured slightly differently. For example, wheelchairs 101 may have components such as controls (not shown) that can impinge on the perimeter of the seat cushion 100. Many manual or power wheelchairs may have armrest frames, leg rigging hardware, etc. (not shown), that must be accommodated. It may be necessary either to have frame members 110*a*, 110*b*, 110*c*, 110*d* that can be modified to accommodate differently configured wheelchairs or to have frame members 110*a*, 110*b*, 110*c*, 110*d* that are specially configured for a given wheelchair model.

Once the perimeter frame members 110*a*, 110*b*, 110*c*, 110*d* are joined together, the straps 113, 114 can be secured to the frame 109 as another step in the custom fabrication process. During the attachment of the straps 113, 114 to the perimeter frame members 110*a*, 110*b*, 110*c*, 110*d*, an initial adjustment of the straps 113, 114 can be done for the intended wheelchair user 108.

Initial Adjustment Using a Pelvic Form

Figure 10:
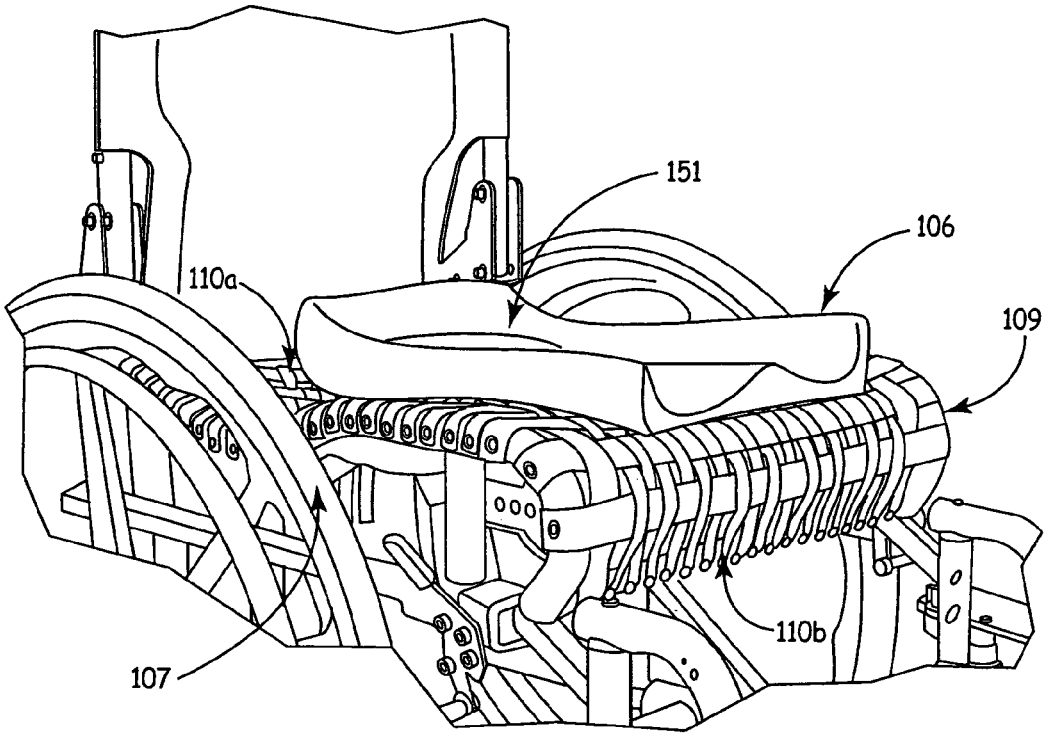
FIG. 10 is an exemplary perspective view of a pelvic form positioned on a seat cushion.

One method for making the initial adjustment is by using a reusable pelvic form 151 as shown in FIG. 10. One or more pelvic forms 151 can be created. A pelvic form 151 is a physical form constructed to represent a particular group of potential users 108. One group might be a small female wheelchair user 108. Another group might be a medium-sized male. Another group might be based on a grouping of anatomical measurements. Other factors such as the level of atrophy could influence how groups are put together. Many other groups based on a variety of criteria can be created.

The pelvic forms 151 can be constructed of many kinds of material; including wood, plastic, and foam, for example. Each form can be made to resemble the bottoms of the legs and the gluteal region including the femur, the pelvis, the gluteal muscles, and the sacral region 143. The forms can be weighted.

The pelvic forms 151 can preferably be constructed based on historical fitting data gathered for fitting wheelchair cushions or other seating devices. The measurements can include the four measurements mentioned above. It also may be preferable to construct the form using data assembled using statistical methods.

To fabricate a seat cushion 100 for a wheelchair user 108, the fabricator can select the pelvic form 151 best matching the intended user's 108 shape for the initial adjustment of the straps 113, 114. For example, data on the intended user 108 may indicate that the user 108 is a small female. In this case, the form corresponding to a small female can be used for the initial adjustment of the straps 113, 114.

At the fabricator's shop, the seat cushion 100 can be attached to a demonstration wheelchair or a jig (not shown) that can have rails similar to a wheelchair 101. The position of the seat cushion 100 in the jig can resemble its likely position in the wheelchair user 108's intended wheelchair 101. Generally, the seat cushion 100 can be positioned on the jig so that the pelvis is level (in the frontal plane) and vertical (or nearly vertical in the sagittal) and the thighs are approximately horizontal or slightly inclined.

The pelvic form 151 can be placed on the wheelchair seat cushion 100 as shown in FIG. 10 in a position that would resemble a user 108 sitting on the cushion 100. Once the form is in position, the straps 113, 114 can be adjusted in order to create a weight bearing surface 112 under the load that has a distinct topography.

FIG. 11 is an exemplary topographic map 152 of the seat cushion's weight bearing surface 112 as it might appear during loading by the pelvic form 151. The solid lines 153 on the topographic map 152 represent contours of equal elevation (as measured from the floor). Each solid line 153 represents a change in elevation of 0.2 in. The dotted lines 154 can represent honey structures of the user 108 or the prominences of the pelvic form 151.

The map 152 shows a pelvic recess 122 as the area of lowest elevation on the seat cushion 100. The ischial tuberosities 149*a*, 149*b* are preferably positioned in the bottom of the pelvic recess 122. The topographic map 152 shows a pronounced rise in elevation on the front side 103 of the pelvic recess 122. The purpose of this rise on the front side 103 of the pelvic recess 122 can be twofold. Gravity can cause the user's pelvis 131 and thighs 155 to slide forward in the seat cushion 100. This action can shear tissue and be very harmful. The rise on the front side 103 of the pelvic recess 122, combined with the overall upward tilt of the seat cushion 100, can resist this sliding.

Moreover, the rise on the front side 103 of the pelvic recess 122 helps unload pressure from the ischial tuberosities 149*a*, 149*b* onto the proximal thigh region 156 thereby creating a "proximal thigh fulcrum." Especially for users 108 whose hamstring muscles (not shown) have atrophied, the rise on the front side 103 of the pelvic recess 122 transfers pressure onto the proximal thighs 156.

The seat cushion 100 is particularly well suited for creating the pronounced rise on the front side 103 of the pelvic recess 122. A rise in the lateral perimeter frame members 110*a*, 110*b*, 110*c*, 110*d* allows the creation of a firm "shelf" under the proximal thighs 156 for offloading pressure from honey prominences of the posterior onto the proximal thighs 156.

The topographic map 152 also shows a less pronounced rise in elevation at the lateral sides of the pelvic recess 122, under the greater trochanters 147*a*, 147*b*. The depressions 115, 116 in the perimeter frame members 110*a*, 110*b*, 110*c*, 110*d* make it possible to avoid contact between the perimeter frame 109 and the greater trochanters 147*a*, 147*b*.

The topographic map 152 also shows a less pronounced rise in elevation at the rear side 102 of the pelvic recess 122. The boney prominences of the sacral region 143 should be protected and have limited (or even no) contact with any part of the wheelchair 101 including the seat cushion 100 or the backrest 157. This can be another significant advantage of the seat cushion 100: the inverted bell-shaped configuration of the rear perimeter frame member 110*a*, as shown in FIG. 3, effectively eliminates contact between the seat cushion 100 and the user's 108 sacral region 143 but still allows contact with other areas with fewer boney prominences.

Finally, the topographic map 152 shows significant rises in elevation in an area that could support the user's gluteal regions 158 posterior to the greater trochanters 147*a*, 147*b*, lateral to the sacral region 143, and inferior the iliac crest. The curved rear faces 159*a*, 159*b* of the weight bearing surface 112 located near the left and right rear corners 117*a*, 117*b* of the seat cushion 100 preferably have good contact with these portions of the gluteal regions 158. This feature of the seat cushion 100 can play a very significant role in lowering pressure and shear forces on boney prominences of the pelvis 131. This feature also provides pelvic stability and proper pelvic orientation and can prevent (with lumbar support) posterior tilt of the pelvis 131.

Once the straps 113, 114 have been adjusted using the pelvic form 151, the next step for the fabricator can be selecting the attachment hardware 132 for attaching the seat cushion 100 to the wheelchair 101. Different wheelchair models may have different set ups for attachment of the seat cushion 100 to the wheelchair 101. Therefore, different attachment hardware 132 may be required for different wheelchair models. Once the proper attachment hardware 132 has been selected, it can be attached to or packaged with the seat cushion 100 and sent with the seat cushion 100 to the fitter.

The Fitting Process

In many instances, a specialist should preferably conduct the fitting. For instance, a Rehabilitation Technology Supplier (RTS) may conduct the fitting in consultation with an occupational therapist (OT) or physical therapist (PT). However, the invention can encompass having other people conduct the fitting. In many instances, the fitter may not need to adjust the straps 113, 114 to alter the weight bearing surface 112 because of the initial adjustment done by the fabricator. However, certain fitting steps should be taken in most cases.

One step is making an overall assessment of the posture of the wheelchair user 108 sitting in the seat cushion 100. These observations might include the erectness of the spine 160, the position of the backrest 157, and so forth. Another step includes adjusting the footrest 161 height. Generally, the footrest 161 should be low enough so the footrest 161 bears only a minor portion of the lower-leg weight. This ensures that the proximal thighs 156 shown in FIGS. 2 and 11 bear their intended share of the weight and form the proximal thigh fulcrum.

If there is "basement space," (i.e., space underneath the seat cushion 100 and the structural component of the wheelchair 101), the final seat height 128 goal can probably be addressed at this point. However, if little "basement space" is available, it may be preferable to make the seat height 128 adjustment after achieving the final optimal pressure distribution. This can prevent having the problem of "bottoming out," where the seat cushion 100 touches the structural components of the wheelchair 101.

Another step for the fitter can be locating potential pressure points. In locating pressure points, the fitter may use pressure mapping systems common in the industry. The seat cushion 100 and fitting methods of the present disclosure offer unique approaches for identifying pressure points that might be generated between the weight bearing surface 112 and the user's body 108. A significant advantage of the seat cushion 100 and a fitting method can be that the person conducting the fitting can view and palpate the underside of the weight bearing surface 112 (i.e., the webbing 111). Such visual and tactile inspection allows the to see or feel where high or low pressure points might exist. These may be indicated by an especially taut strap 113, 114 or a loose strap 113, 114. In another embodiment, a flexible material such as clothing is disposed between the user and the weight bearing surface. The visual and tactile inspection involves seeing or feeling extension of the flexible material through the voids of the weight bearing surface.

In addition, if a pressure mat (not shown) is used, the fitter can identify very precisely the location of high or low pressure points. By pressing on the weight bearing surface 112 from the underside, the fitter can momentarily increase pressure at a chosen point on the underside of the weight bearing surface 112. This momentary creation of pressure by the fitter can be used to identify correspondence between locations on the pressure map display and locations on the seat cushion 100 weight bearing surface 112. This can all be done with the wheelchair user 108 sitting on the wheelchair seat cushion 100 without, for example, jamming the fitter's hand between the seat surface and the sitter.

The fitter can identify locations on the weight bearing surface 112 in several different ways. The fitter can count straps 113, 114 using the straps 113, 114 as a grid. See FIG. 5. For example, a location on the weight bearing surface 112 that creates excessive pressure might be identified by counting transverse straps 113 from the front to the back and longitudinal straps 114 by counting from left to right looking forward. Moreover, numbers representing the straps 113, 114 can be printed on perimeter frame members 110*a*, 110*b*, 110*c*, 110*d* (not shown). Alternatively, the fitter can use other methods such as marking the location with tape or a fastener such as a paper clip (not shown).

If the fitter determines that excessive pressure may exist at certain points, the fitter can make adjustments. In many instances, the fitter may only need to loosen or tighten a few straps 113, 114. For example, if a pressure point was identified at the intersection 162 of the fourth longitudinal strap 114 and the seventh transverse strap 113, the fitter may only have to loosen those two straps 113, 114. This can be done by removing the retainer 125 holding those straps 113, 114 at one of the perimeter frame members 110*a*, 110*b*, 110*c*, 110*d* and backing off one or more holes on the selected straps 113, 114.

In another step, the fitter can adjust the height of the seat cushion 100—the seat-to-floor height 128 as shown in FIG. 2. For the seat cushion 100, the seat-to-floor height 128 can be determined by measuring seat to floor height at the four corners 117*a*, 117*b*, 117*c*, 117*d* of the seat cushion 100. (Measurement from two corners 117*b*, 117*d* is shown in FIG. 1B) The fitter can make changes to the seat height 128 using the height adjustment mechanism 129. (Seat height adjustments may in turn require changes to the footrest 161 position in order to maintain the proper distribution of weight on the proximal thighs 156.)

As mentioned above, for most users 108, the weight bearing surface 112, overall, should be level or have a rearward tilt. This appears on the topographic map 152 in FIG. 11 as the difference in elevation at the lowest point (2.8 in.) in the pelvic recess 122 and at the highest point (4.6 in.) near the front 103 of the seat cushion 100 for one embodiment. For users 108 with significant muscle atrophy, the difference in elevation from the lowest point in the pelvic recess 122 to the highest point may be greater than shown here.

The final step of the fitter may be to repeat the first step—to make an overall assessment of the posture of the wheelchair user 108 sitting in the seat cushion 100. These observations might include the erectness of the spine 160, the position of the backrest 157 on the back, and so forth.

These steps may be repeated or the order of the steps may be changed based on the unique anatomical features of the wheelchair user 108 and the structure of the wheelchair 101. Many of the adjustments made may necessitate readjustments of other elements. For example, changing in depth of the pelvic recess 122 or the height 128 of the seat cushion 100 may necessitate readjusting the height of the footrest 161.

Figure 13:
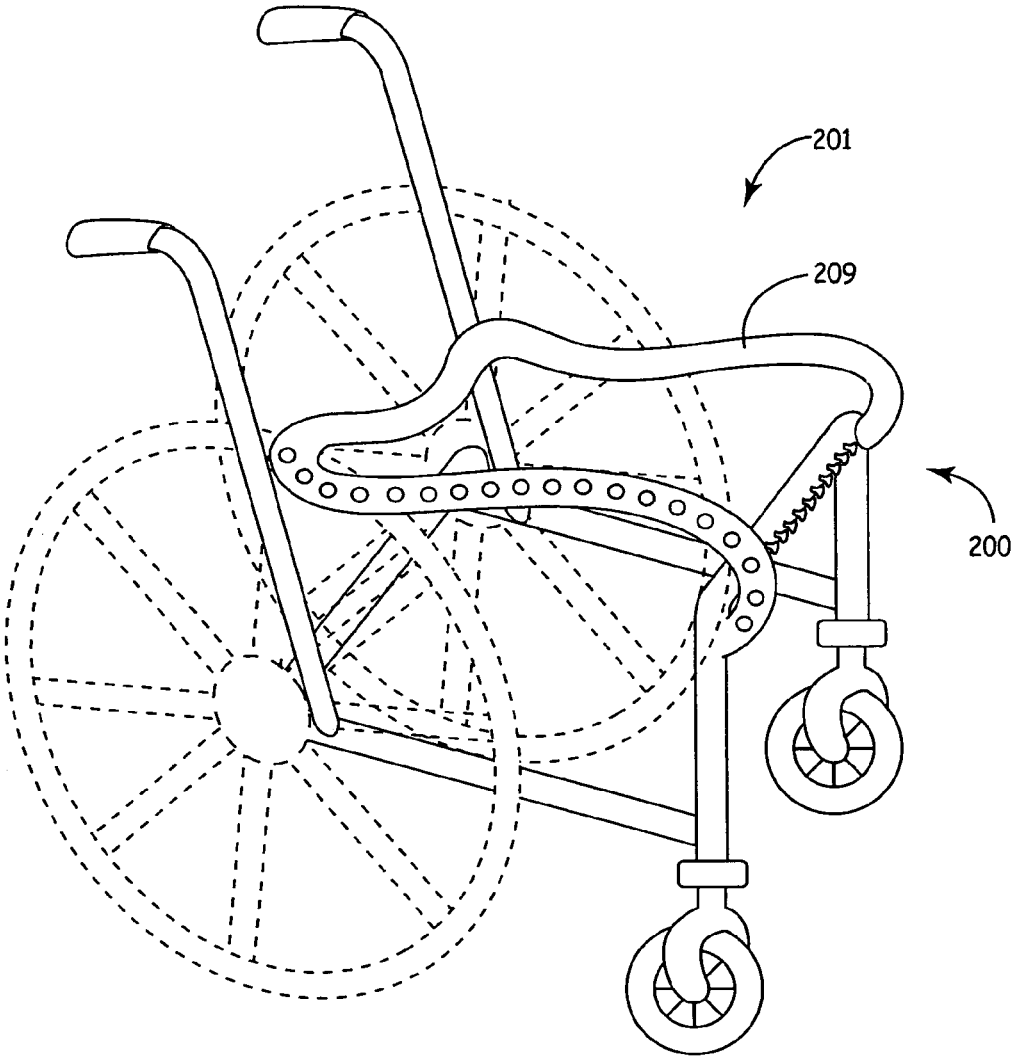
FIG. 13 is a perspective view of wheelchair with an integrated seat cushion perimeter frame according to a second embodiment.

FIG. 13 shows another example of the seat cushion 200 (showing only the frame 209). In this example, the frame 209 is incorporated directly into the structure of the wheelchair 201. The seat cushion 200 functions much the same as the seat cushion 100 described in the first example in relation to FIGS. 1 to 12.

Incorporating the frame 209 of the seat cushion 200 directly into the structure of a wheelchair can have many advantages. By having the seat cushion 200 as part of the frame of the wheelchair 201, the architecture of the wheelchair 201 can be used to reinforce the frame 209. This means a much lighter and more stable seat cushion 200 can be created. Moreover, many parts can be entirely eliminated. These can include the attachment hardware, which add weight and the potential for increased instability.

Finally, the area underneath the seat cushion 200 can become very open. By eliminating parts such as the attachment hardware and the wheelchair rails, the fitter can have unobstructed access to the underside of the weight bearing surface (not shown). This can make adjustments and assessment of underside of the weight bearing surface (as described earlier) much easier. In addition, the fitter can, if necessary, create deeper depressions such as the pelvic recess in order to accommodate a user's anatomy without running the risk of "bottoming out" on the structure of the wheelchair.

The disclosed seat cushions (in their various embodiments) can be inexpensively custom fabricated and fit for a user in comparison to prior art custom fabricated seat cushions. Custom fabricated cushions in the prior art often require making an impression, making a cast from an impression, and molding a seat using the cast. Even after this, the seat cushion may need modifications to meet the needs of the user for a good fit.

The disclosed seat cushion's adjustable webbed weight bearing surface can be custom shaped to the particular contours of many different users with unique anatomy. For example, the seat cushion can effectively be used to create depressions, firm surfaces, and so forth. This can be critical in creating a weight bearing surface that can conform to the shape of the body and can offload pressure and shear from tissue at and near honey prominences.

The seat cushion's contoured perimeter frame can be especially effective in creating a weight bearing surface that can manage pressure and shear. The depression in the rear portion of the lateral perimeter frame permits the creation of a weight bearing surface with a more pronounced rise in the front part of the pelvic recess. This rise makes transferring some (though not necessarily all) pressure onto the underside of the thighs (and posterior lateral gluteal areas) easier, helps hold the pelvis in position to maintain postural alignment, and prevents the forward slide of the pelvis and thighs.

The depression in the rear portion of the lateral perimeter frame permits the creation of a weight bearing surface with a less pronounced rise in the lateral parts of the pelvic recess. (If a non-contoured frame were deployed, a greater depression in the webbing could be used to create a depression of similar depth.) Having a less pronounced rise in the lateral parts of the pelvic recess can minimize the potential for contact between the greater trochanters and the perimeter frame. This can permit use of a seat cushion with less width because the greater trochanters can be nearer the lateral perimeter frame members without creating a potential danger of coming in contact with them. Having a less pronounced rise in the lateral parts of the pelvic recess can also reduce contact (if desired) between the webbing and the greater trochanters.

The shape of the rear perimeter frame member with its inverted bell shaped curve offers several benefits. The sacral region of the user's body with its multiple boney prominences does not have to contact a part of the weight bearing surface. Moreover, good contact can be obtained with the posterior-lateral gluteal regions so that load can be transferred to these areas. This enhances the ability to affect pressure distribution, increases pelvic stability, and maintains pelvic orientation (alignment). Finally, the depression in the rear perimeter frame permits the creation of a weight bearing surface with a less pronounced rise in the rear part of the pelvic recess. (If a non-contoured frame were deployed, a greater depression in the webbing would have to be used to create a depression of similar depth.)

The substantially rigid perimeter frame to which the straps can attach, the substantially inelastic straps, and the strap fixtures that firmly hold the straps can all contribute to a stable and consistent weight bearing surface. This can ensure that the shape of the weight bearing surface can persist until a re-adjustment is desired.

The seat cushion can provide a weight bearing surface that can be easily accessed from the underside. The fitter can easily view the underside of the weight bearing surface. The fitter can easily touch the underside of the weight bearing surface. This can allow a method of fitting in which the fitter views and/or touches the underside of the weight bearing surface and material pressing through the voids in the webbing to identify locations of high or low pressure. It also permits the fitter to touch the underside of the weight bearing surface in order to increase pressure temporarily. This temporary pressure increase can show up on a pressure map display and make identification of locations on the weight bearing surface easier.

The seat cushion provides excellent ventilation, thereby minimizing heat build-up. The voids in the webbing provide very direct access to the ambient air, even if a lightweight cover is placed over the webbing. This contrasts with seat cushions made of various kinds of foam, rubber, gel, liquid, and solid plastics, etc., that inhibit airflow around the seat weight bearing surface.

The webbing material can also be relatively thin and provide very little insulation. This can all aid in the dissipation of heat. Dissipation of heat can be critical because temperature elevation can increase metabolism, which means that body cells both require more nourishment and produce more waste. If circulation is impaired, either pathologically or mechanically (by ischemia), the rate of tissue damage can increase.

Moreover, ventilation provided by the open webbing of the seat cushion also promotes the dissipation of moisture. Moist skin can be more prone to damage and degradation than dryer skin.

The seat cushion's weight bearing surface can be easily adjusted and, if necessary, easily readjusted. Readjustment can be critical because a user's body can change as it ages, as muscles atrophy, and so forth. This contrasts especially with seat cushions that have been molded from foam. Adding material to such a molded seat can be expensive, time consuming, and can require special equipment. While it is possible to easily adjust (letting air in or out of) a pneumatic cushion, it is very difficult (if not impossible) to confirm the results without using a pressure mapping tool if the wheelchair user has impaired sensation.

The disclosed seat cushion can be easily maintained. Cleaning the straps can be very easy, especially if the straps are non-absorbent. Any cover placed on the seat cushion 100 can be cleaned separately such as in a washing machine.

The disclosed seat cushion can provide a very stable weight bearing surface. Many seat cushions such as those that have fluid or air-filled compartments lose pressure due to leakage or changes in atmospheric pressure. The disclosed seat cushion, on the other hand, can offer a very stable weight bearing surface over the long term.

The methods of fabricating and fitting the seat cushion can have many additional advantages and benefits. An initial adjustment of the weight bearing surface can be done based on user profile data (such as anatomical measurements). This initial adjustment can be done by the fabricator and can make the fitting quicker and easier for the fitter.

A pelvic form (custom or standard) can be used to fabricate the seat cushion. A pelvic form can be especially useful for an initial adjustment without the presence of the prospective seat cushion user.

Other embodiments of a seat (not shown) could incorporate other features than those discussed above. Other embodiments could combine features discussed above in different ways.

The seat cushions discussed above can have a weight bearing surface that can be adjusted. A seat according to other embodiments can have a weight bearing surface that is non-adjustable or has limited adjustability—for example, a seat with a weight bearing surface that can be adjusted during fabrication but not after fabrication is complete.

The seat cushions discussed above can preferably be used as a wheelchair seat cushion. However, the seat cushion can be used for other kinds of seats such as seats for scooters, office chairs, automobiles, and so forth. In fact, the concepts set forth here can be used for various kinds of weight bearing surfaces including backrests, beds, and so forth.

The seat cushions described above has a contoured perimeter frame. Other examples of the invention can have perimeter frames contoured differently or can have one or more frame members that do not have a contour.

The present invention should not be considered limited to the particular examples described above, but rather should be understood to cover all aspects of the invention as fairly set out in the claims arising from this application. For example, while suitable sizes, materials, fasteners, and the like have been disclosed in the above discussion, it should be appreciated that these are provided by way of example and not of limitation as a number of other sizes, materials, fasteners, and so forth may be used without departing from the invention. Various modifications as well as numerous structures to which the present invention may be applicable will be readily apparent to those of skill in the art to which the present invention is directed upon review of the present specifications. The claims, which arise from this application, are intended to cover such modifications and structures.

Although the present invention has been described with reference to preferred embodiments, workers skilled in the art will recognize that changes may be made in form and detail without departing from the spirit and scope of the invention.

What is claimed is:

1. A seat on which a user sits, the seat comprising:

a perimeter frame comprising:

a front frame member;

two contoured lateral frame members, each lateral frame member having a front portion, a second portion proximate the user's thighs, a concave curve portion proximate the user's pelvis, and a rear portion, a bottom of the concave curve portion being lower than the second portion and lower than the rear portion; and a contoured rear frame member having a central dip portion; and a weight bearing surface on which the user sits, the surface comprising a plurality of straps attached to the perimeter frame.

2. The seat of claim 1 wherein the plurality of straps are configured in a tabby weave pattern.

3. The seat of claim 1 wherein an end of a strap is attached to the perimeter frame.

4. The seat of claim 1 wherein a strap is adjustably attached to the perimeter frame.

5. The seat of claim 1 further comprising padding overlying the weight bearing surface.

6. The seat of claim 1 wherein the front portion of each lateral frame member has a downward curve.

7. The seat of claim 1 wherein the second and rear portions of each lateral frame member are substantially straight.

8. The seat of claim 1 wherein a strap comprises a plurality of holes therein.

9. The seat of claim 8 wherein the plurality of holes are positioned throughout a length of the strap.

10. The seat of claim 1 wherein the weight bearing surface comprises a plurality of woven flexible straps.

11. The seat of claim 10 wherein the plurality of woven straps are longitudinally inelastic.

12. The seat of claim 1 wherein the weight bearing surface has a depression proximate the concave curve portion of the lateral frame members and proximate the central dip portion of the rear frame member.

13. The seat of claim 1 installed on a wheelchair aftermarket.

14. The seat of claim 1 integrated into the design and construction of a wheelchair.

15. The seat of claim 1 wherein the perimeter frame is rigid.

16. The seat of claim 1 wherein the weight bearing surface comprises a plurality of transverse straps orthogonally intersecting a plurality of longitudinal straps.

17. A method of making a seat comprising:

weaving a plurality of flexible straps into a weight bearing surface and securing each of the straps onto a contoured perimeter frame, wherein the perimeter frame comprises:

a front frame member;

two contoured lateral frame members, each lateral frame member having a downward curving front portion, a substantially straight second portion proximate the user's thighs, a concave curve portion proximate the user's pelvis, and a substantially straight rear portion, a bottom of the concave curve portion being lower than the second portion and lower than the rear portion; and a contoured rear frame member having a central dip portion;

placing a pelvic form on the weight bearing surface; and adjusting one or more straps to conform the weight bearing surface to the pelvic form.

18. The method of claim 17 wherein a pressure point between the form and the weight bearing surface is determined by tactile inspection of an underside of the weight bearing surface.

19. The method of claim 17 wherein a pressure point between the form and the weight bearing surface is determined by a visual inspection of an underside of the weight bearing surface.

20. The method of claim 17 wherein an end of a strap is attached to the perimeter frame.

21. The method of claim 17 wherein an end of a strap is attached to the strap.

22. The method of claim 17 further comprising attaching the seat to a wheelchair.

23. A method of fitting a seat to a user comprising:

providing a seat comprising:

a perimeter frame comprising:

a front frame member;

two contoured lateral frame members, each lateral frame member having a downward curving front portion, a substantially straight second portion proximate the user's thighs, a concave curve portion proximate the user's pelvis, and a substantially straight rear portion, a bottom of the concave curve portion being lower than the second portion and lower than the rear portion; and a contoured rear frame member having a central dip portion; and a weight bearing surface on which the user sits, the surface comprising a plurality of woven flexible straps having voids therebetween, wherein each strap is adjustably attached to the perimeter frame;

seating the user on the weight bearing surface; and adjusting one or more straps to conform the weight bearing surface to the user, thereby forming a pelvic recess in the weight bearing surface.

24. The method of claim 23 wherein a pressure point between the user and the weight bearing surface is determined by tactile inspection of an underside of the weight bearing surface.

25. The method of claim 24 wherein the pressure point is detected by feeling for a taut or loose strap.

26. The method of claim 23 wherein a pressure point between the user and the weight bearing surface is determined by a visual inspection of an underside of the weight bearing surface.

27. The method of claim 23 wherein a flexible material is disposed between the user and the weight bearing surface.

28. The method of claim 27 wherein a pressure point between the user and the weight bearing surface is determined by tactile inspection of an underside of the weight bearing surface comprising feeling portions of the flexible material extending through the voids in the weight bearing surface.

29. The method of claim 27 wherein a pressure point between the user and the weight bearing surface is determined by visual inspection of an underside of the weight bearing surface comprising looking for portions of the flexible material extending through the voids in the weight bearing surface.

30. The method of claim 23 wherein providing the seat comprises:

taking a first anatomical measurement of the user, with the user's knee bent about 90 degrees, corresponding to a length between a sacral region and popliteal knee region; and choosing a seat having lateral side members compatible with the first anatomical measurement.

31. The method of claim 23 wherein adjusting the one or more straps comprises:

taking a second anatomical measurement of the user, with the user's knee bent about 90 degrees, corresponding to a length between a sacral region and greater tronchanter; and positioning the pelvic recess to be compatible with the second anatomical measurement.

32. The method of claim 23 wherein providing the seat comprises:

taking a third anatomical measurement of the user corresponding to a length between left and right greater tronchanters; and choosing a seat having front and rear frame members compatible with the third anatomical measurement.

33. The method of claim 23 wherein adjusting the one or more straps comprises:

taking a fourth anatomical measurement of the user corresponding to a length between left and right anterior superior iliac spine members; and positioning the pelvic recess to be compatible with the fourth anatomical measurement.

34. The method of claim 23 further comprising inserting a pressure mapping device between the user and the weight bearing surface.

35. The method of claim 34 wherein a location on the weight bearing surface is determined by touching an underside of the weight bearing surface to temporarily increase a pressure reading of the mat corresponding to that location.

* * * * *